US007717417B2

(12) United States Patent
Murrell

(10) Patent No.: US 7,717,417 B2
(45) Date of Patent: May 18, 2010

(54) DEVICES FOR IMPROVING THE RELIABILITY OF FEEDING MEDIA SHEETS WITHIN AN IMAGE FORMING DEVICE

(75) Inventor: Niko Jay Murrell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 308 days.

(21) Appl. No.: 11/765,466

(22) Filed: Jun. 20, 2007

(65) Prior Publication Data

US 2008/0315499 A1 Dec. 25, 2008

(51) Int. Cl.
*B65H 3/52* (2006.01)

(52) U.S. Cl. ..... 271/121

(58) Field of Classification Search ..... 271/109, 271/121, 117, 118
See application file for complete search history.

(56) References Cited

U.S. PATENT DOCUMENTS 4,523,832 A * 6/1985 Strutt et al. ..... 399/388
5,476,255 A * 12/1995 Murcko et al. ..... 271/121
2004/0046309 A1* 3/2004 Lee et al. ..... 271/121
2005/0001371 A1* 1/2005 Otsuki ..... 271/113
2006/0257194 A1* 11/2006 Chen ..... 400/629
2009/0250867 A1* 10/2009 Samoto ..... 271/117

FOREIGN PATENT DOCUMENTS

JP 63258332 A * 10/1988

* cited by examiner

*Primary Examiner*—Patrick Mackey
*Assistant Examiner*—Gerald W McClain
(74) *Attorney, Agent, or Firm*—David Kalish; John Victor Pezdek

(57) ABSTRACT

The present application is directed to devices and methods for moving media sheets in an image forming device. In one embodiment, a contact member includes a contact roller that contacts a top-most media sheet in a stack of media sheets positioned on a support surface in an input area of the image forming device. A hub extends outward from an axial side of the contact roller. The hub includes a smaller length than the contact roller, forming a gap between the hub and the top-most media sheet when the contact roller is in contact with the top-most media sheet. The hub prevents or reduces transverse buckling of the top-most media sheet when it is moved from the stack of media sheets.

16 Claims, 6 Drawing Sheets

DEVICES FOR IMPROVING THE RELIABILITY OF FEEDING MEDIA SHEETS WITHIN AN IMAGE FORMING DEVICE

BACKGROUND

The present application is directed to methods and devices for moving media sheets in an image forming device and, more specifically, to methods and devices for preventing and/or reducing transverse buckling of media sheets within the image forming device.

An image forming device, such as a color laser printer, facsimile machine, copier, all-in-one device, etc, includes a media feed system for introducing and using media sheets. The media feed system includes an input area where media sheets are initially placed prior to being introduced into a media path. A pick mechanism may also be located in the input area to contact and move a media sheet from the input area and into the media path. The proper functioning of the device requires that media sheets are fed reliably and consistently, as well as maintaining the proper timing between media sheets.

New image forming devices are trending towards lower cost, smaller height/footprint, and higher print quality. The smaller sizes have various advantages including that the devices fit within a smaller workspace and a reduction in shipping and packaging costs. In order to conserve space, a primary input tray and a multipurpose feeder may be located in the same general horizontal plane.

SUMMARY

The present application is directed to devices and methods for moving media sheets in an image forming device. In one embodiment, a contact member includes a contact roller that contacts a top-most media sheet in a stack of media sheets positioned on a support surface in an input area of the image forming device. A hub extends outward from an axial side of the contact roller. The hub includes a smaller diameter than the contact roller, forming a gap between the hub and the top-most media sheet when the contact roller is in contact with the top-most media sheet. The hub prevents or reduces transverse buckling of the top-most media sheet when it is moved from the stack of media sheets.

DETAILED DESCRIPTION

Figure 2:
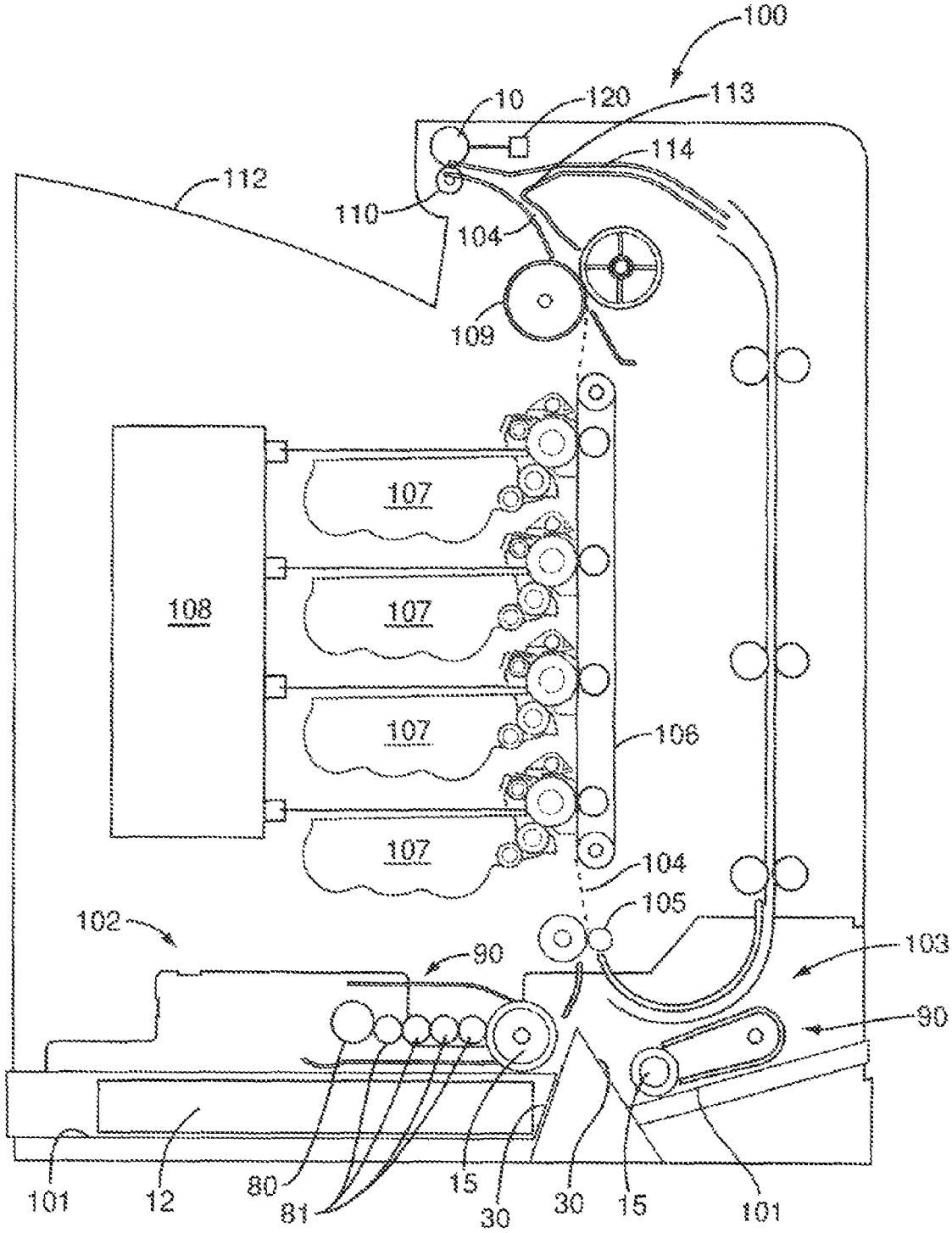
FIG. 2 is a schematic view of an image forming device according to one embodiment.

The contact member 15 includes a contact roller 14 that contacts a top-most media sheet in a stack of media sheets 12. The stack of media sheets 12 is positioned on a support surface 101 in an input area 102 of the image forming device 100 (FIG. 2). A hub 17 extends outward from an axial side of the contact roller 14. The hub 17 includes a smaller diameter than the contact roller 14. A gap 19 is formed between the hub 17 and the top-most media sheet 12 when the contact roller 14 is in contact with the top-most media sheet 12. The hub 17 prevents or reduces transverse buckling of the top-most media sheet 12 when it is moved from the stack of media sheets 102.

To understand the context of the present application, FIG. 2 depicts a representative image forming device 100. The input area 102 includes a support surface 101 to receive a stack of media sheets 12. In this embodiment, the support surface 101 is formed by an input tray. The contact member 15 may include the contact roller 14 and the hub 17 and is positioned adjacent to the support surface 101 for the contact roller 14 to contact and introduce the media sheets 12 into a media path 104. Input area 102 may also include a multipurpose feeder 103. Multipurpose feeder 103 includes a support surface 101 to support one or more media sheets 12, and a contact member 15 including a con tact roller 14 and a hub 17 to contact and move the media sheets 12 into the media path 104.

Media sheets 12 are moved from the input area 102 and fed into a primary media path 104. One or more registration rollers 105 align the media sheets 12 and precisely control its further movement along the media path 104, A media transport belt 106S forms a section of the media path 104 for moving the media sheets 12 past a plurality of image forming units 107. Color printers typically include four image forming units 107 for printing with cyan, magenta, yellow, and black toner to produce a four-color image on the media sheet 12.

An imaging device 108 forms an electrical charge on a photoconductive member within the image forming units 107 as part of the image formation process. The media sheet 12 with loose toner is then moved through a fuser 109 that adheres the toner to the media sheet 12. An exit roll 10 forming a nip with a nip roll 110 is positioned at an output area. The exit roll 10 is driven by a motor 120 and rotates in a forward direction to expel the media sheet 12 from the device 100 and out to an output tray 112. Alternatively, the exit roll 10 may rotate in a forward direction for a limited time until a trailing edge of the media sheet 12 passes an intersection point 113 along the media path 104. The exit roll 10 is then rotated in a reverse direction to drive the media sheet 12 into a duplex path 114. The duplex path 114 directs the inverted media sheet 12 back through the image formation process for forming an image on a second side of the media sheet 12.

Figure 3:
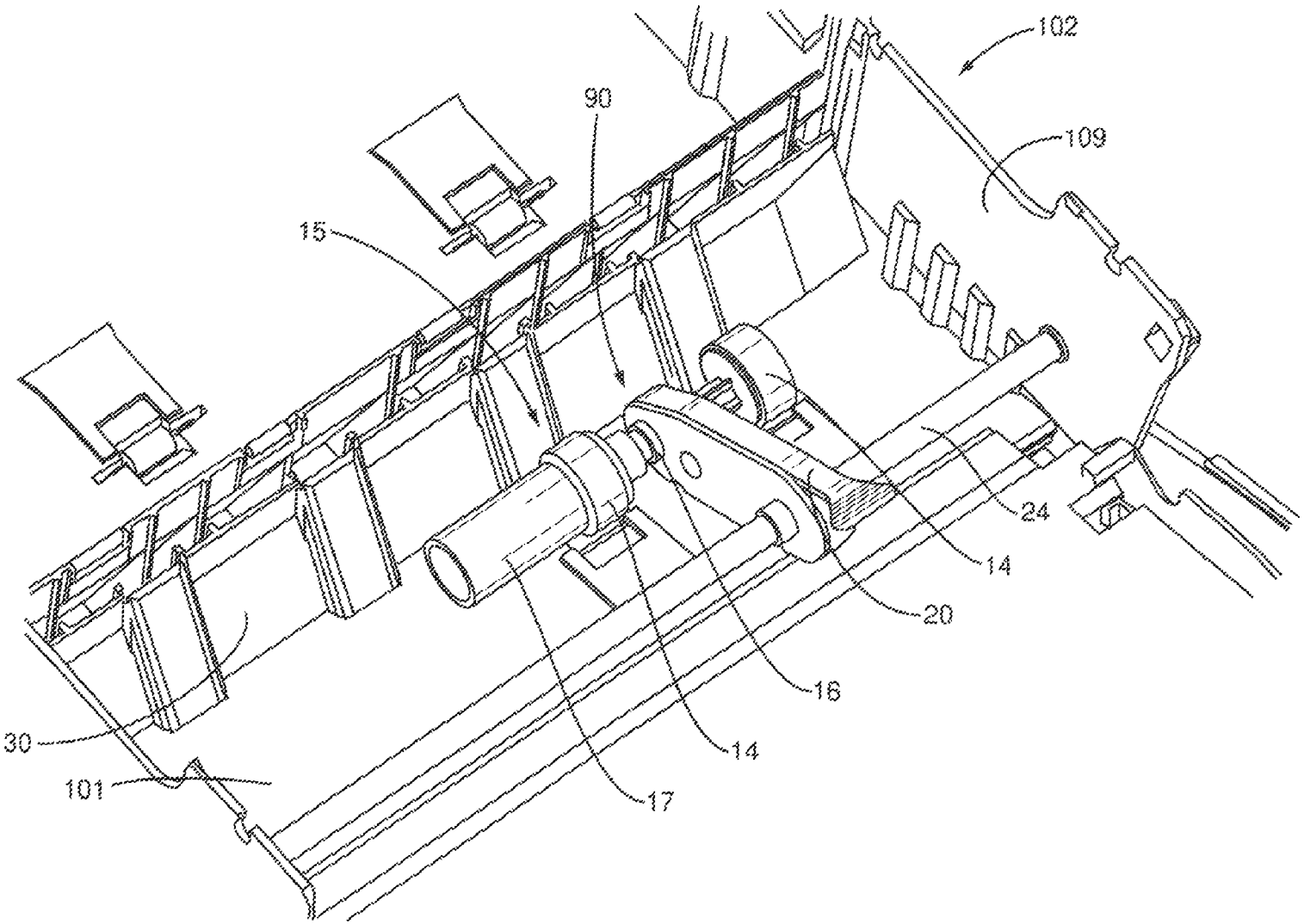
FIG. 3 is a perspective view of an input mechanism according to one embodiment.

Examining the input area 102 now in more detail, FIG. 3 illustrates one embodiment of an input mechanism 90 positioned at the support surface 101. A dam 30 may be positioned at one end of the support surface 101 to direct the media sheets 12 from the input area 102 into the media path 104. The darn 30 may be part of an input tray (as illustrated in FIG. 3), or may be part of the body of the device 100, as illustrated at the multipurpose feeder 103 of FIG. 2. As the input mechanism 90 moves a top-most media sheet 12 from the media stack, a normal buckle may be formed in the sheet 12 that is substantially perpendicular to the direction of feed. The normal buckle ensures that a single media sheet is moved from the stack and prevents or reduces simultaneously moving multiple sheets. The single sheet 12 moves from the stack, contacts the dam 30, and is directed upward into the media path 104.

The input mechanism 90 includes a pick arm 20 pivotally positioned or a shaft 24. A drive shaft 16 extends outward from a distal end of the pick arm 20. In one embodiment as illustrated in FIG. 2, a gear train 81 is positioned within the pick arm 20 and extends between a pick motor 80 and the drive shaft 16. Activation of the pick motor 80 causes rotation of the drive shaft 16.

One or more contact rollers 14 are attached to the drive shaft 16. In the embodiment of FIG. 3, a pair of contact rollers 14 is attached to the shaft 16 with one on each side of the pick arm 20. The pivoting orientation of the pick arm 20 maintains the contact rollers 14 in contact with a top-most media sheet 12 on the support surface 101. The contact rollers 14 are typically constructed of a material with a high coefficient of friction to reduce slippage with the topmost media sheet 12 during rotation of the contact roller 14.

Figure 1:
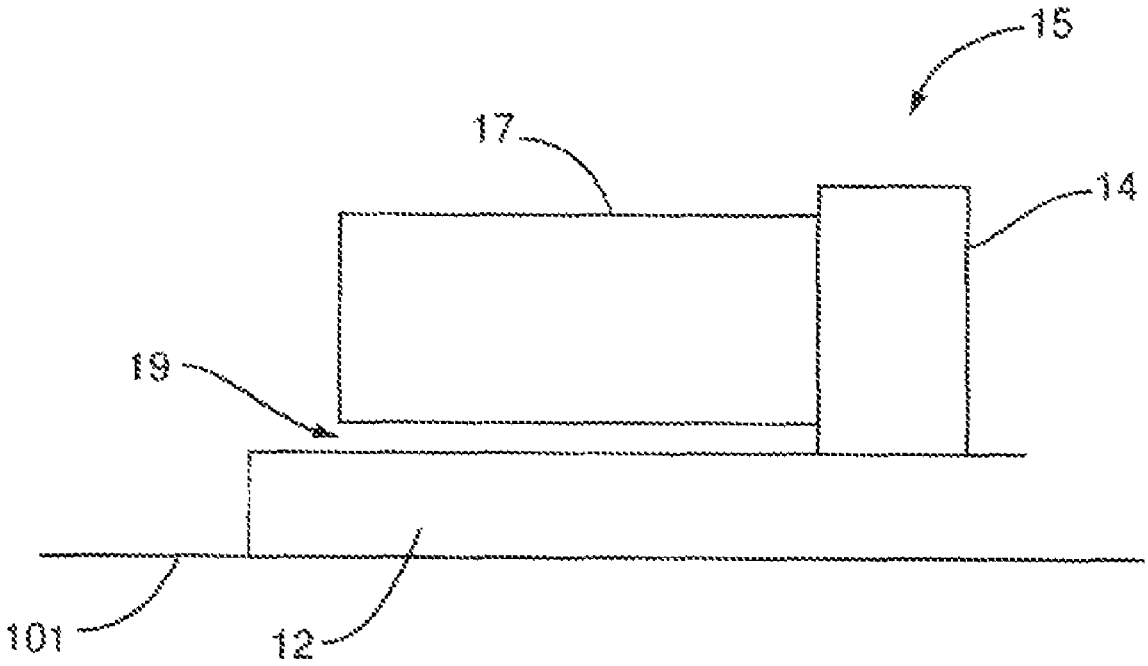
FIG. 1 is a schematic view of an input mechanism according to one embodiment.
Figure 4:
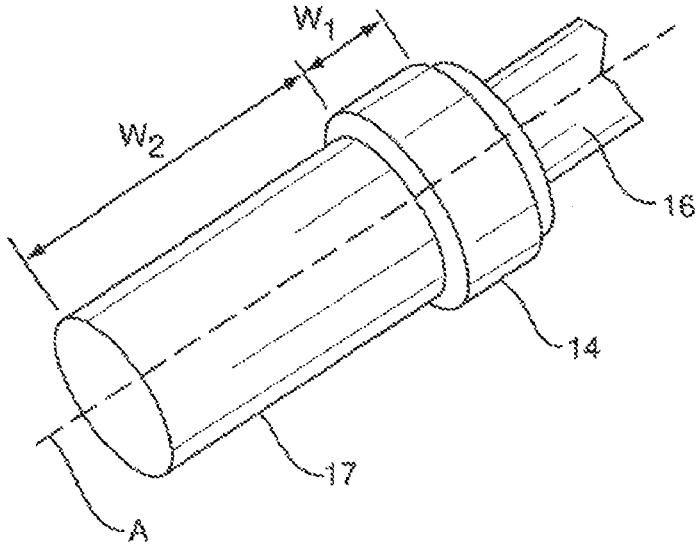
FIG. 4 is a perspective view of a contact roller and hub according to one embodiment.

A cantilevered hub 17 has one end connected to an axial side of contact roller 14 and has a free end extending outwardly from the axial side of the contact roller 14. Hub 17 extends outwardly from the contact roller 14 in a direction away from the pick arm 20 (see FIGS. 1 and 3). As illustrated in FIG. 4, hub 17 is positioned coaxially with the contact roller 14 and drive shaft 16 along a longitudinal axis A. The contact roller 14 has a width $W_1$ that extends along the axis A, and the hub 17 has a width $W_2$ along the axis A. The width $W_1$ is selected to provide adequate contact with the top-most media sheet to move the sheet 12 away from the support surface 101. The width $W_2$ of the hub 17 is selected in one embodiment such that the hub 17 extends over at least a portion of the top-most media sheet 12. In one embodiment, media sheets 12 are side justified against an edge 109 of the input area 102. The input mechanism 90 is positioned and the width $W_2$ is selected such that the hub 17 extends over an edge of the media sheet 12. In one embodiment, $W_2$ is greater than $W_1$.

Figure 5:
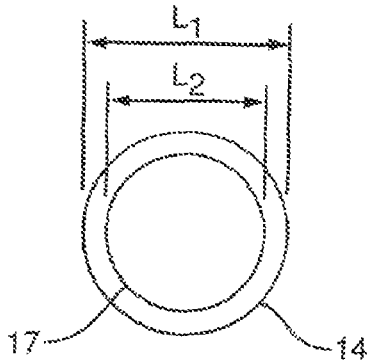
FIG. 5 is schematic end view of a contact roller and a hub according to one embodiment.

A schematic end view of the contact roller 14 and hub 17 is shown in FIG. 5. In one embodiment, a length $L_1$ of the contact roller 14 is greater than a length $L_2$ of the hub 17. The difference between $L_1$ and $L_2$ defines the gap 19 between the hub 17 and the top-most media sheet 12 on the support surface 101. In one embodiment, the gap 19 is about 0.5 mm. The hub 17 may be substantially solid as shown in FIG. 5, or may have a hollow interior as shown in FIG. 3.

Figure 6:
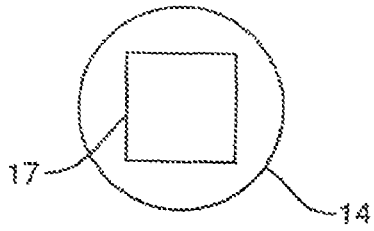
FIG. 6 is schematic end view of a contact roller and a hub according to one embodiment.
Figure 7:
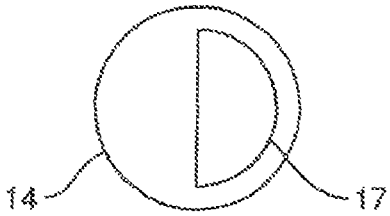
FIG. 7 is schematic end view of a contact roller and a hub according to one embodiment.
Figure 8:
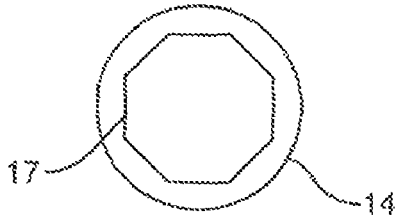
FIG. 8 is schematic end view of a contact roller and a hub according to one embodiment.

The cross-sectional shape of the hub 17 may vary. FIG. 5 illustrates one embodiment with both the contact roller 14 and the hub 17 having circular cross-sectional shapes. FIG. 6 illustrates an embodiment with a rectangular cross-sectional shape, and FIG. 8 illustrates a polygonal cross-sectional shape. Additionally, the hub 17 may not be symmetrical with respect to the cross sectional shape of the contact roller 14 as, illustrated in FIG. 7. In this embodiment, the gap 19 formed between the hub 17 and the top-most media sheet 12 varies depending upon the rotational position of the hub 17.

As stated previously, the media sheets 12 are moved from the media stack to the media path 104. The contact roller 14 is rotated and initiates movement of the top-most media sheet 12. The contact roller 14 may form a normal buckle in the media sheet 12 that prevents more than one media sheet from being simultaneously moved from the media stack. The normal buckle is substantially perpendicular to the direction of feed. A leading edge of the media sheet 12 makes contact with the dam 30 such that the movement of the media sheet 12 changes from a substantially horizontal plane (i.e., essentially parallel to the support surface 101) to a plane at a vertical angle with the horizontal plane. The normal buckle in the media sheet 12 ideally forms a smooth bend in order to make this transition. During this movement, a transverse buckle may be formed in the media sheet 12. The transverse buckle is substantially parallel to the direction of feed. The transverse buckle increases a beam strength of the media sheet 12 causing it to resist the creation of the normal buckle. The media sheet with the transverse buckle is more difficult to feed and may result in media jams and improper timing of the media sheet.

Transverse buckling is most prevalent in a media sheet with multiple layers, such as an envelope. Envelopes generally include multiple layers formed by front and back sides, and a flap that closes the envelope. As the envelope is moved from the support surface 101, the contact roller 14 contacts a single layer. This may cause the other envelope layers that are not contacted to move from the support surface 101 at a different speed. This speed differential causes formation of the transverse buckle.

As the media sheet 12 begins to form a transverse buckle, the transverse buckle makes contact with the hub 17. This contact operates to arrest further development of the transverse buckle and prevents the transverse buckle from exceeding a size of the gap 19. The transverse buckle, then, is not allowed to reach the critical limit where a crimp forms thus allowing it to be fed more reliably. In one embodiment, the hub 17 rotates along with the contact roller 14. In another embodiment, the hub 17 does not rotate.

In one embodiment, the hub 17 is constructed of a material with a coefficient of friction substantially lower than the coefficient of friction of the con-tact roller 14. The lower coefficient of function may allow the hub 17 to contact the media sheet 12 without imparting a driving force. Thus, when the transverse buckle makes contact with the hub 17, the hub 17 does not apply a significant additional driving force to the media sheet 12 as compared to the contact roller 14. This reduces the possibility of skewing the media sheet 12 as a result of contact with the hub 17. The contact roller 14 may be constructed from a variety of materials including but not limited to isoprene rubber and cork. The hub 17 may be constructed from a variety of materials including but not limited to thermoplastics such as acrylonitrile butadiene styrene, plastics and metals.

In one embodiment, the smaller the gap 19 the more efficiently the hub 17 breaks down the transverse buckle into smaller creases. However, the size of the gap 19 may be adjusted to account for particular characteristics of the media sheet 12 being fed. For example, a smaller gap 19 may be used with thinner and more flexible media sheets 12. Such media sheets 12 may more easily form smaller creases that fit within the gap. Thicker and stiffer media sheets 12 may require a larger gap because transverse buckles in such media sheets 12 may not easily break down into smaller creases without permanently distorting the media or result in a misfeed.

In one embodiment, the hub 17 is removable from the contact roller 14. Hubs 17 with different widths and lengths may be attached to the contact roller 14 to accommodate feeding of the particular media sheets 12. For example, a hub 17 with a length only slightly smaller length than the contact roller 14 may be used when feeding sheets of 20 pound bond paper. However, a hub 17 with a greater difference in length than the contact roller 14 may be required to reliably feed envelopes constructed from 40 pound Bristol paper. In another embodiments the width $W_2$ of the hub 17 may also be varied to accommodate media sheets 12 of different overall dimensions.

Figure 9:
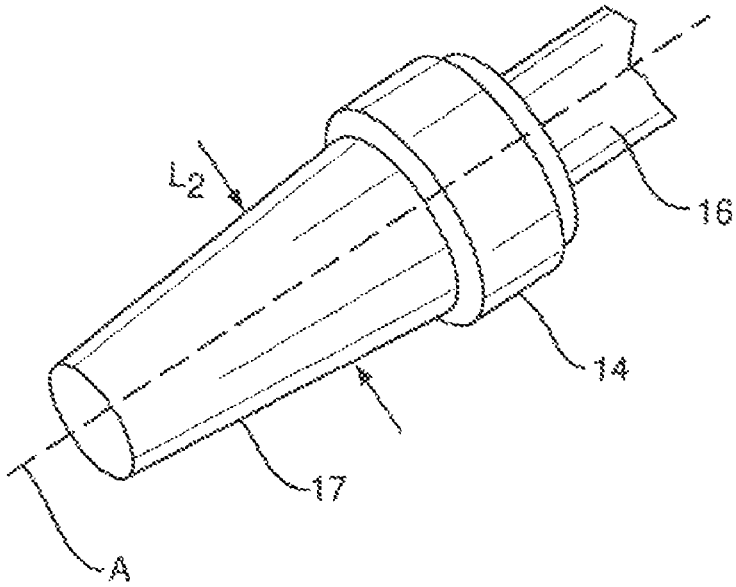
FIG. 9 is perspective view of a contact roller and hub according to one embodiment.
Figure 10:
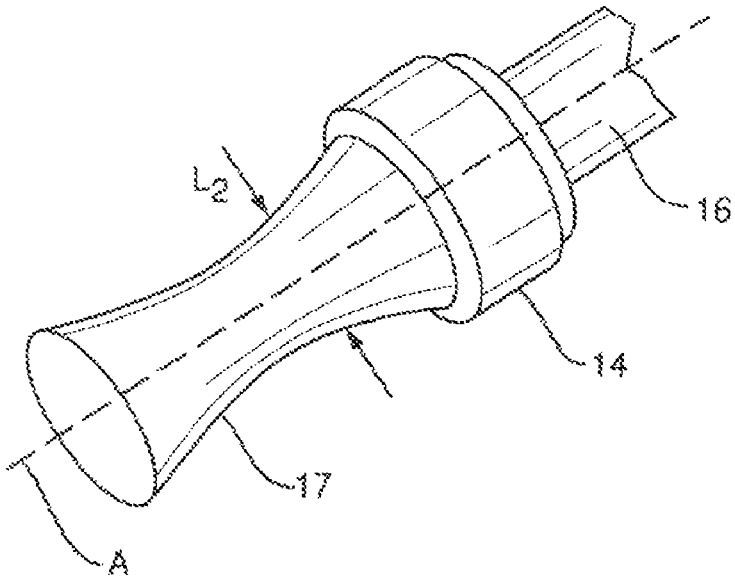
FIG. 10 is a perspective view of a contact roller and hub according to one embodiment.

The embodiment illustrated in FIG. 4 shows the hub 17 with an essentially constant length along the axis A. In another embodiment as illustrated in FIG. 9, the hub 17 is tapered. In this embodiment, the length $L_2$ of the hub decreases in a direction along the axis A away from the contact roller 14. The length $L_2$ may decrease essentially linearly as illustrated in FIG. 9. In another embodiment (not shown), the length $L_2$ decreases non-linearly. FIG. 10 illustrates another embodiment of the hub 17 where the length $L_2$ initially decreases along the axis A in a direction away from the contact roller 14, then the length $L_2$ increases.

Figure 11:
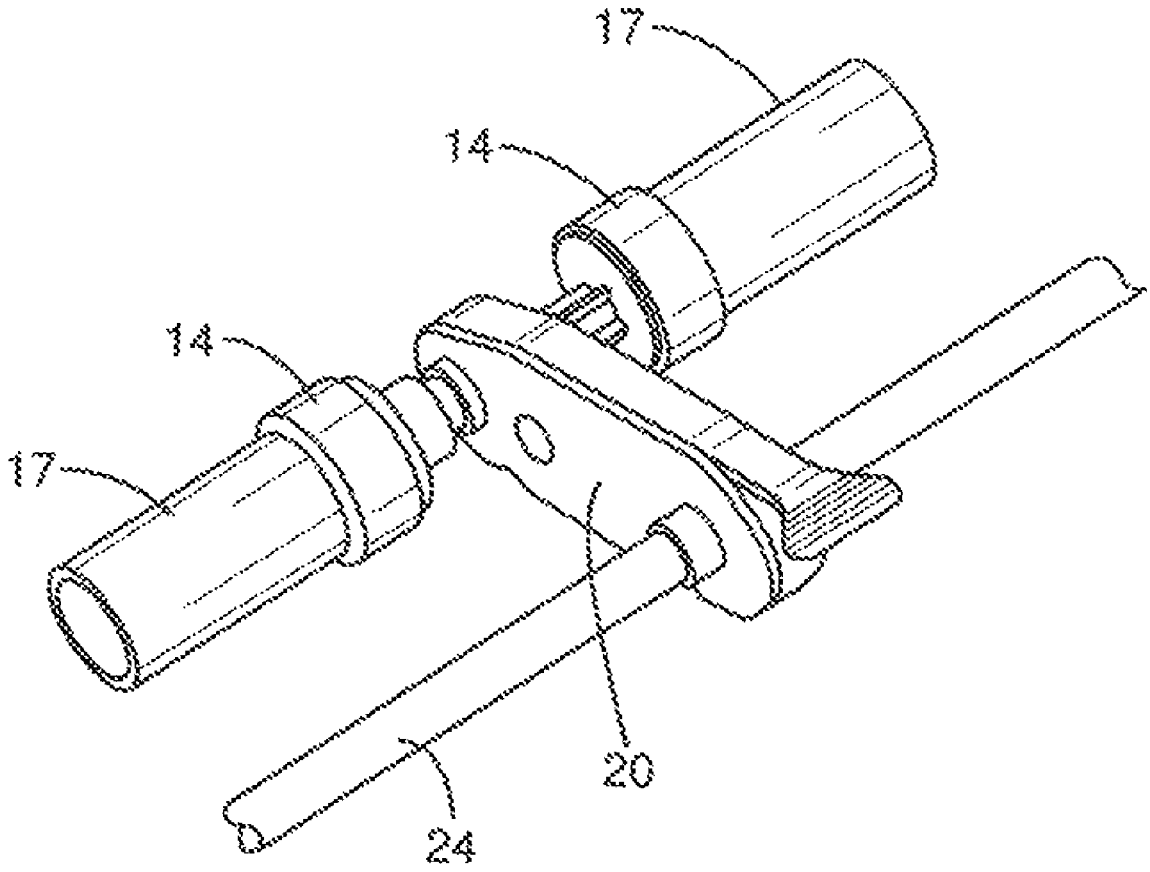
FIG. 11 is a perspective view of an input mechanism according to one embodiment.

The embodiment illustrated in FIG. 3 illustrates a hub 17 connected to a first contact roller 14. In the embodiment illustrated in FIG. 11, hubs 17 are connected to each of the contact rollers 14. The second hub 17 may be essentially identical to the first hub 17. In another embodiment, the width and/or length of the second hub 17 may vary from that of the first hub 17.

The embodiment of FIG. 2 illustrates one or more hubs 17 in use at an input section 102 of the image forming device 100. Hubs 17 may be used in other areas within the image forming device 100. In one embodiment, media sheets 12 are stacked during movement through the primary media path 104 or duplex path 114. One or more hubs 17 may be attached to contact rollers 14 in these areas to arrest transverse buckles during feeding of the media sheets 12.

The present assembly is applicable to preventing and/or reducing transverse buckling in media sheets with multiple layers, such as envelopes. The assembly may also be used with other multiple layer media sheets such as carbon-copy materials. Additionally, the assembly may also be used to prevent and/or reduce transverse buckling in various other types of media sheets such as but not limited to paper, transparencies, and card stock.

Terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present application may be carried out in other specific ways than those herein set forth without departing from the scope and essential characteristics of these embodiments. The present embodiments are, therefore, to be considered in all respects as illustrative and not restrictive, and all changes coming within the meaning and equivalency range of the appended claims are intended to be embraced therein.

What is claimed is:

1. An assembly for moving a top-most media sheet from a stack of media sheets within an image forming device, the assembly comprising:

a contact roller positioned over the stack of media sheets in contact with the top-most media sheet; and a cantilevered hub having one end removably connected to an axial side of the contact roller and a free end extending outwardly from the axial side of the contact roller and at least partially over the top-most media sheet, the hub having a smaller diameter than the contact roller to form a gap between the hub and the top-most media sheet wherein rotation of the contact roller and the hub moves the top-most media sheet from the stack of media sheets and prevents the top-most media sheet from forming a transverse buckle greater than the height of the gap.

2. The assembly of claim 1, wherein the contact roller and the hub are oriented coaxially along a longitudinal axis.

3. The assembly of claim 1, wherein the hub is generally cylindrical.

4. The assembly of claim 1, wherein the hub includes a hollow interior.

5. The assembly of claim 1, wherein a distance from an outer edge of the contact roller to the hub varies around the circumference of the contact roller.

6. The assembly of claim 1, wherein the length of the hub varies along an axial direction away from the contact roller.

7. The assembly of claim 1, wherein a coefficient of friction of an outer surface of the contact roller is greater than an outer surface of the hub.

8. The assembly of claim 1, wherein a difference between the diameter of the contact roller and the diameter of the hub is selected based on characteristics of the media sheet.

9. The assembly of claim 1 wherein the hub is tapered along its width.

10. An assembly for moving a top-most media sheet from a stack of media sheets within an image forming device, the assembly comprising:

a contact member positioned over the stack of media sheets, the contact member comprising:

a substantially cylindrical contact section with an outer surface that contacts the top-most media sheet; and a cantilevered buckle arresting section having one end removably attached to an axial end of the contact section and a free end extending therefrom, the contact section including a greater diameter than the buckle arresting section;

wherein rotation of the contact member causes the outer surface of the contact section to frictionally engage with the top-most media sheet and move the top-most media sheet away from the stack of media sheets, the buckle arresting section preventing a section of the top-most media sheet that extends outward beyond the axial end of the contact section from forming a transverse buckle beyond a predetermined size.

11. The assembly of claim 10, wherein a width of the buckle arresting section is greater than a width of the contact section.

12. The assembly of claim 10, wherein the contact section and the buckle arresting section have different cross-sectional shapes.

13. The assembly of claim 10, wherein the buckle arresting section is in a non-contact orientation with the top-most media sheet prior to the contact section rotationally engaging the top-most media sheet.

14. The assembly of claim 10, wherein the predetermined size of the transverse buckle is determined by the difference between the diameter of the contact section and the diameter of the buckle arresting section.

15. The assembly of claim 14, wherein the predetermined size remains constant for any number of media sheets in the stack of media sheets.

16. The assembly of claim 10 wherein the buckle arresting section is tapered along its width.

* * * * *